US005454643A

United States Patent [19]

Sullivan

[11] Patent Number: 5,454,643

[45] Date of Patent: Oct. 3, 1995

[54] COMBINATION BEACH TOWEL AND TOTE BAG

[75] Inventor: William Sullivan, Santa Tecla, El Salvador

[73] Assignee: Fashion Towel Imports Corp., Miami, Fla.

[21] Appl. No.: 375,532

[22] Filed: Jan. 19, 1995

[51] Int. Cl.[6] ..... B65D 30/10

[52] U.S. Cl. ..... 383/4; 383/40; 383/75; 383/127

[58] Field of Search ..... 383/4, 38, 39, 383/40, 75, 127

[56] References Cited

U.S. PATENT DOCUMENTS

| | | | |
|---|---|---|---|
| 751,033 | 2/1904 | Weed | 383/127 X |
| 1,844,808 | 2/1932 | Spangler | 383/127 X |
| 1,936,045 | 11/1933 | Bachrach | 383/40 X |
| 2,028,070 | 1/1936 | Johnson | 383/127 X |
| 4,516,668 | 5/1985 | Grayek | 383/4 X |
| 4,600,091 | 7/1986 | McLeod | 383/4 X |
| 5,244,278 | 9/1993 | Robitaille | 383/4 |
| 5,346,308 | 9/1994 | Bubot et al. | 383/4 |

*Primary Examiner*—Jes F. Pascua

*Attorney, Agent, or Firm*—Malin, Haley, DiMaggio & Crosby

[57] ABSTRACT

A combination beach towel and tote bag comprising a towel made of fiber-reactive dyed velour on one side for a decorative pattern and a pair of rectangular panels attached to one corner of said beach towel, occupying approximately one-sixth the surface area of the beach towel, said panels being sized in shape and connected to form a tote bag when turned inside out for receiving the remainder of the towel and presenting decorative designs on the outside of said tote bag. The towel is easily deployed and easily folded neatly and inserted into the tote bag.

3 Claims, 3 Drawing Sheets

COMBINATION BEACH TOWEL AND TOTE BAG

BACKGROUND OF THE INVENTION

1. Field of the Invention

This invention relates to the combination of a beach towel and a tote bag, and specifically to an improved beach towel and tote bag combination that provides both a practical and decorative beach towel made of fiber-reactive dyed velour of high quality that includes a strategically placed pocket and tie straps that permit the device to be used as a tote bag that conveniently holds the remaining towel structure. In the towel mode, the tote bag portion acts as a security pocket that includes closure ties.

2. Description of the Prior Art

A trip to the beach requires some type of covering which is placed on the sand, such as a mat or large beach towel, to prevent the user from getting sand on the body. Numerous accessories are also required for the beach, such as suntan lotion, sunglasses, and other paraphernalia for full enjoyment of the beach. Devices for carrying towels and paraphernalia to the beach are known in the prior art. U.S. Pat. No. 2,626,648, issued Jan. 27, 1953 to Anderson, shows a combination towel and beach bag. U.S. Pat. No. 4,856,912, issued Aug. 15, 1989 to Damus et al., shows a combination beach towel and tote bag. U.S. Pat. No. 3,477,552, issued Nov. 11, 1969 to Goldman, shows a combination mat and tote bag. U.S. Pat. No. 4,195,378, issued Apr. 1, 1980 to Parker, shows a multiple purpose beach equipment device. One of the drawbacks of the prior art is that the tote bag itself is generally either small or it interferes with lying on the beach towel in some cases. The overall construction of these devices tends to be ill-suited for mass production techniques and retaining a certain decorative, festive look or indicia on the beach towel and tote bag itself.

The present invention overcomes these problems by providing an improved beach towel that is conventional in size, shape, and construction materials, while at the same time providing in combination a tote bag that has ample storage space for the towel body portion and beach accessory items. Also, the beach towel and tote bag in combination provide for a decorative, aesthetically pleasing pattern using fiber-reactive dyed velour. Another important advantage of the present invention is that the towel can be easily deployed from the tote bag to change the mode of use and also readily stored in a neatly folded configuration within the tote bag.

Velour, as used in the description herein, refers to any of various fabrics with a pile or nap surface resembling velvet used in towels, and especially beach towels. In the preferred embodiment, cotton velour is used and has been very acceptable on one side of the towel of the towel having a velour surface for providing dyeing of very decorative colors. Although cotton velour is clearly the most desirable, other equivalent fabrics suitable for use as towels and decorative surfacing can be utilized.

SUMMARY OF THE INVENTION

A combination beach towel and tote bag comprising a rectangular cotton fiber-reactive dyed velour towel substantially 60 inches in length and 30 inches in width having a tote bag first and second panels affixed to one corner area. The towel has a decorative pattern on one side provided by the fiber-reactive dye on the velour surface. The velour is essentially a plurality of cut cotton loops that are formed on one side of the towel which is the decorative side. The other side of the towel can be made of uncut loops.

A first tote bag panel, also made of the same cotton fiber-reactive dyed velour material, having a decorative pattern on one side, is rectangular and sized approximately 17 inches in length and 14 inches in width and is attached by stitching to one corner of said towel. The attached first panel has four sides, three sides of which are stitched and permanently attached to the corner of the towel. The first panel end edge that is parallel and adjacent the towel narrower end is not stitched. The first panel unstitched end edge includes an overlapping loop that is stitched back upon itself for containing a rope or tie-down cord. A second tote bag panel having the cotton fiber-reactive dyed velour on one side (with the same decorative pattern as the towel and the first tote bag panel) is attached to the towel in the same corner position as the first tote bag panel. The decorative velour surface of the second panel is positioned flush against the first panel, all of which are attached together.

In a first mode of operation of the invention as a beach towel, the towel can be readily used (decorative side up) with the tote bag portion essentially flush with the towel, not interfering with the user. The total bag panels (first and second) are affixed to the non-decorated, non dyed surface of the towel on the bottom side of the towel that would be against and contact the beach surface. The top surface of the towel has the decorative ornamentation provided by the fiber-reactive dye on the velour surface.

When the towel is in use in the first mode of operation, the tote bag pocket can still be used to receive objects, such as car keys, wallets, or sun screen products, fastened securely in the tote bag by the cords.

In the second mode of operation, the towel portion can be neatly folded in rectangular segments so that the folded towel portion can be readily placed and neatly stored in the tote bag when the tote pocket is turned inside out. Once the towel portion is folded into rectangular sections and the tote bag portion first and second panels are turned inside out, the towel is neatly stored in the tote bag. Note that the tote bag formed by the first panel and the second panel has velour surfaces on both sides for aesthetic and decorative purposes.

In the tote bag mode, the tie cord ends can be fastened together to secure both the towel portion inside the bag pocket and the other beach accessories that are stored in the tote bag to secure them in place within the tote bag. The tie cord ends can also be used as a handle for carrying the tote bag.

A threaded, stitched channel forms the tie cord-holding channel around the one edge of the towel and tote bag. The tie cord may be made of one-quarter to half inch rope that can be tied in a loop and secured at each end.

It is an object of this invention to provide an improved combination beach towel and tote bag that is easily deployed and easily folded.

It is another object of this invention to provide a beach towel and tote bag that are constructed of fiber-reactive dyed velour on one side of the towel and on the outside of the tote bag in the tote bag mode for enhanced aesthetic improvement.

It is another object of this invention to provide an improved combination beach towel and tote bag that is easy to transfer from one mode to the other that leaves a substantial amount of excess room in the tote bag mode while at the same time providing a standardized beach towel of normal size and width for use on the beach.

But yet still another object of this invention is to provide an improved combination beach towel and tote bag that, when in the beach towel mode, allows the user to lie on the towel without interference from the tote bag.

In accordance with these and other objects which will become apparent hereinafter, the instant invention will now be described with particular reference to the accompanying drawings.

DESCRIPTION OF THE PREFERRED EMBODIMENTS

Figure 1:
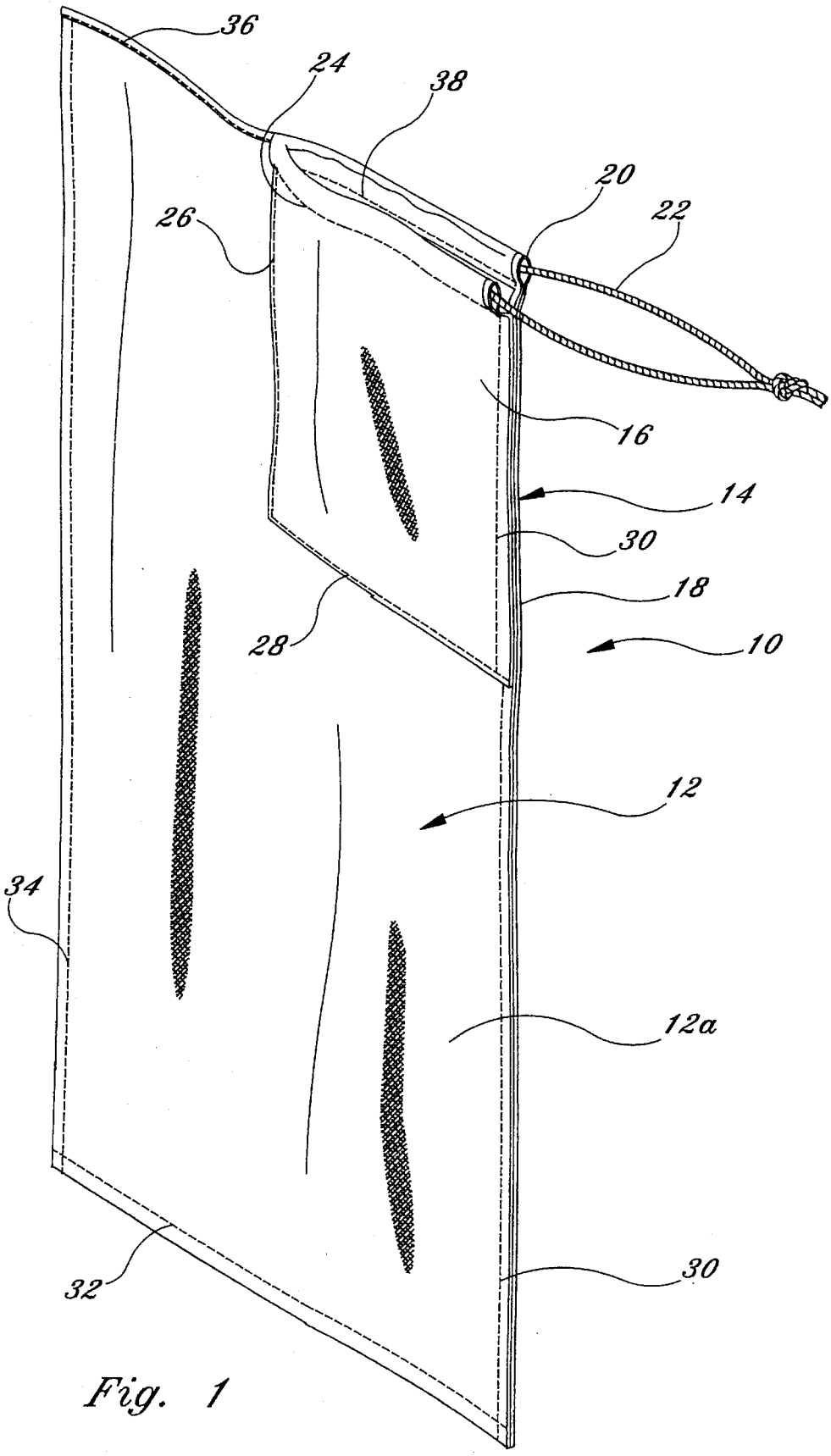
FIG. 1 shows a perspective view of the present invention in the beach towel mode.

Referring now to the drawings and in particular FIG. 1, the present invention is shown generally at 10 comprised of a rectangular beach towel 12 constructed of a fiber-reactive dyed velour on one side 12*b* (see FIG. 2) with side 12*a* comprising hooked cotton. Side 12*b* with the reactive dyed velour can contain a decorative design or pattern that has been applied to the velour surface, indicated by flower 12*c*. A first panel 16 made of the same material as the towel is sized as a rectangle whose length is approximately one-third of the total length of the towel and whose width is approximately one-half of the width of the towel (17 inches by 14 inches in the preferred embodiment). First panel 16 occupies approximately one-sixth of the area of the towel 12. A second panel 40 of the same dimensions as the first panel 16, also made of cotton and having one side with a fiber-reactive dyed velour and a matching decorative pattern, is stitched and occupies approximately one-sixth of the area of towel 12 in one corner of towel side 12*a*. Towel 12 is typically sized as a beach towel and could be 60 inches long and 30 inches wide. The decorative sides of the first panel and second panel face each other inside the pocket formed by the first and second panels.

The tote bag is comprised of first panel 16 which is stitched along stitches 26 and 28 to towel 12 in one corner and along the side edge by stitching 30. The top of the tote bag is formed integrally with the tote bag 14 by providing a circular channel 20 formed by sewing the top portion of panels 16 and 40 about the top surface of the towel to form channel 20 that receives a rope or tie cord 22.

As shown in FIG. 1, the invention is in a beach towel mode. The tote bag 14 has a pocket that can receive articles and beach accessories while the user still has sufficient room of five-sixths of the towel area for sitting or reclining on the beach.

Figure 2:
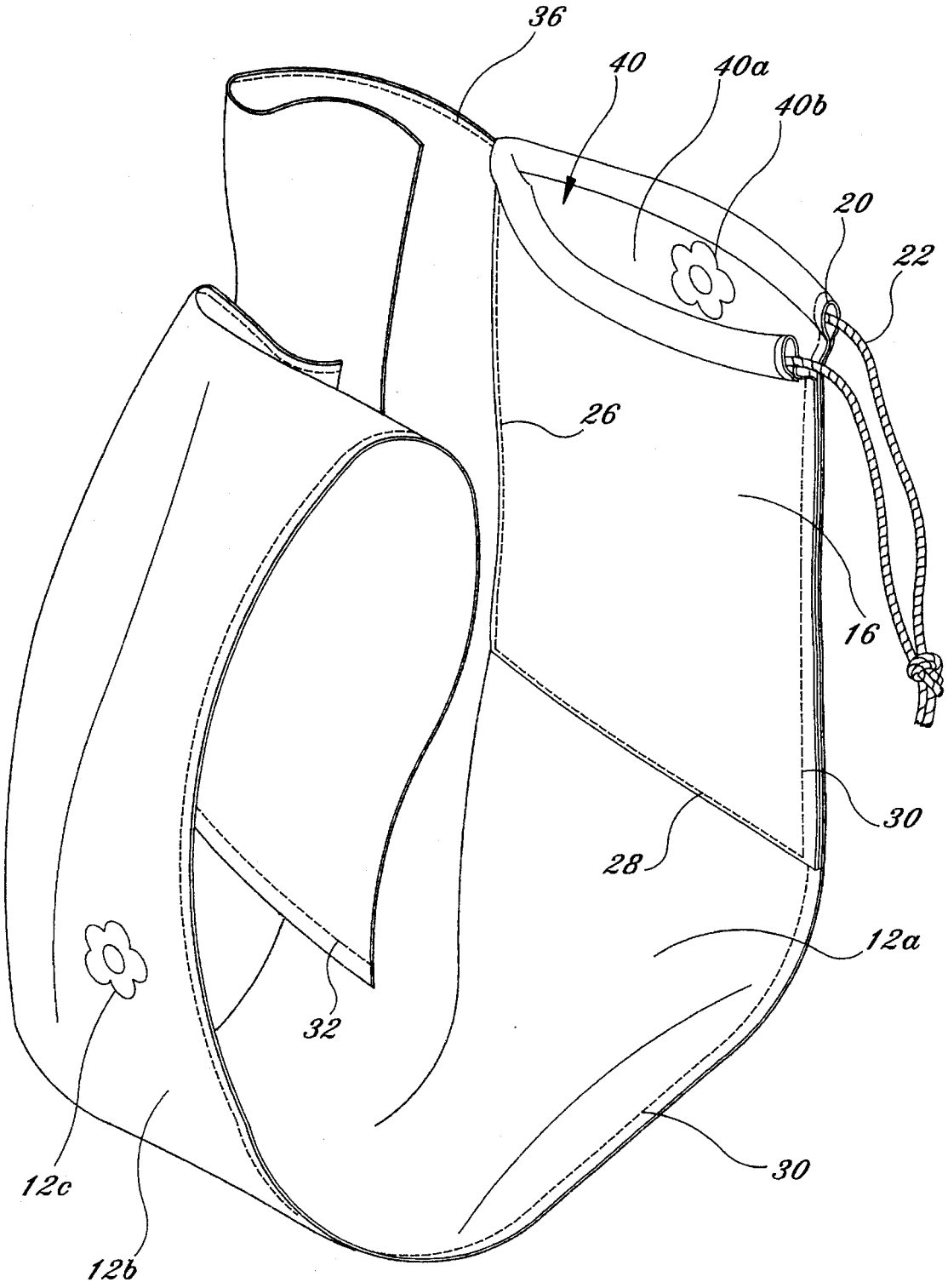
FIG. 2 shows a perspective view of the present invention in an intermediate stage between the towel mode and the tote bag mode.
Figure 3:
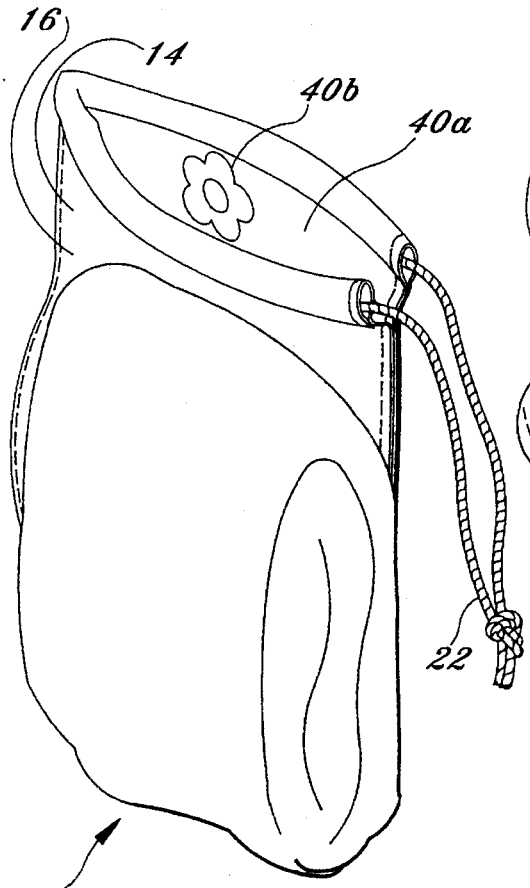
FIG. 3 shows a perspective view of the present invention in an intermediate mode of folding of the towel in sections.
Figure 4:
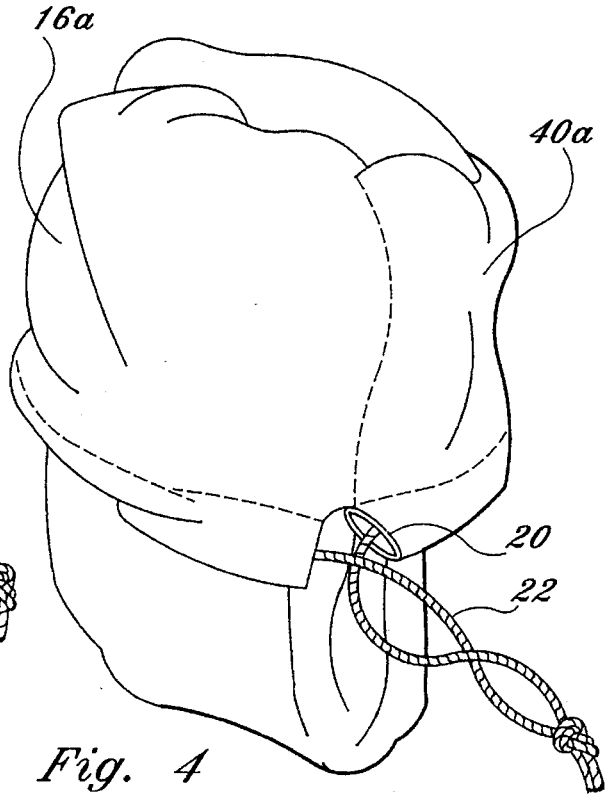
FIG. 4 shows a perspective view of the present invention with the tote bag portion being folded over the folded towel portion.

Referring now to FIGS. 2–4, the combination beach towel and tote bag is shown in transitional states that allow the towel 12 to be folded up and the tote bag pocket to be turned inside out. FIG. 2 shows a first full view laterally and vertically, showing the dyed velour side 12*b* which is indicated by a design flower 12*c* that is part of the velour surface pattern of 12*b*.

FIG. 3 shows substantially the towel folded up and adjacent the tote bag, represented by first panel 16*a* and second panel 40*a*.

In FIG. 4, first panel 16 and second panel 40 are inverted, exposing first panel 16*a* the inside velour decorated surface and decorated surface 40*a* having the dyed velour and flower design 40*b*.

Figure 5:
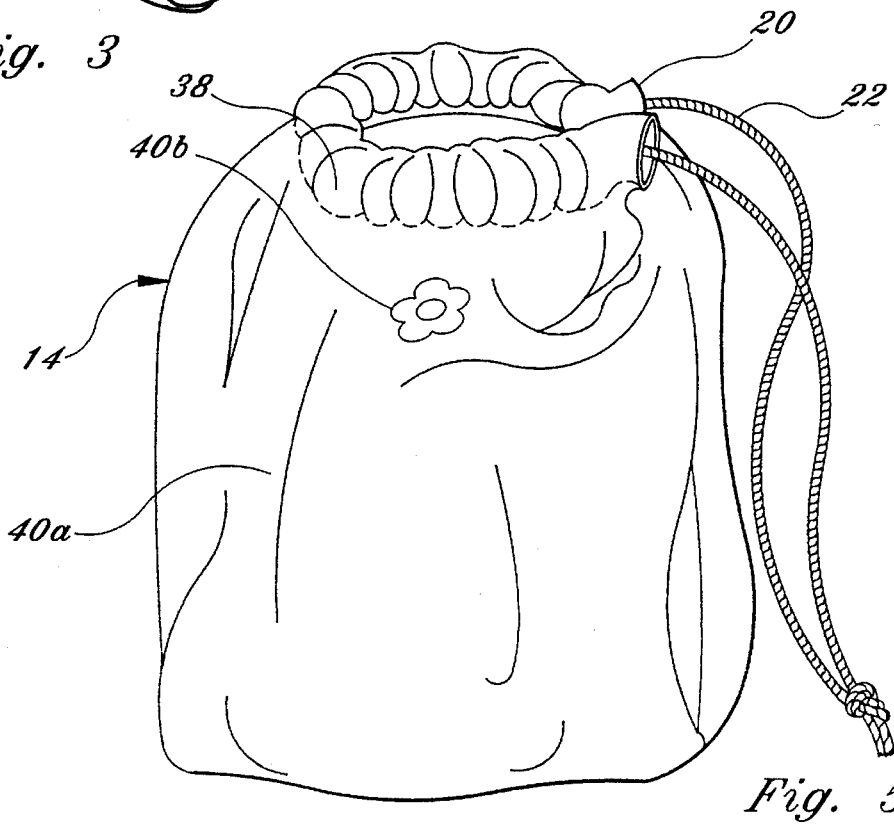
FIG. 5 shows a perspective view of the present invention in the tote bag mode.

FIG. 5 shows the tote bag 14 which still has the towel folded inside with plenty of room left to carry additional articles. Note that the tote bag now is decoratively colored by flower 40*b* exposing the dyed velour texture outwardly.

As shown in FIG. 1, the tote bag first panel 16 can be approximately 17 inches long and 14 inches wide to occupy approximately one-sixth area for the maximum and most efficient fold, while giving the user substantial use of the entire beach towel without interference of the tote bag. Note that with the cord or rope 22 in either the beach towel mode of FIG. 1 or the tote bag mode of FIG. 5, the rope can be pulled to reduce the size of the tote bag opening and secure objects inside in either mode.

Although the towel as shown is constructed from a cotton fiber-reactive dyed velour, other conventional towel materials capable of aesthetic patterns can be utilized. Another advantage of the invention is that in the tote bag mode, the invention can be flat-shipped, saving shipping space.

In summary, the towel is easily and neatly folded to fit within the tote bag, while the towel is also easily deployed. The aesthetic appearance remains consistent in both modes of operation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A beach towel and integrated tote bag combination having a first mode of use as a towel and a second mode of use as a tote bag, wherein said towel is stored in said tote bag in said second mode comprising:

a substantially rectangular fabric sheet, said sheet sized substantially for use as a beach towel and having a length of approximately 60 inches and a width of approximately 30 inches, said sheet having one side with velour texture thereon;

a first substantially rectangular panel having a length approximately one-third the length of said fabric sheet and a width approximately one-half the width of said sheet, said first panel fastened along three sides of said first panel to a corner section of said fabric sheet and occupying one-sixth the surface area of said fabric sheet;

a second substantially rectangular panel having length and width dimensions substantially equivalent to the length and width of said first panel, said second panel being fastened along three sides to the three sides of said first panel to define a tote bag having an opening;

said first panel and said second panel having an unfastened side that is folded over, forming a rope receiving channel along the opening of the tote bag; and a rope having first and second ends slidably disposed within said channel, wherein said rope permits closing of the tote bag.

2. A beach towel and tote bag as in claim 1 wherein:

said fabric sheet is constructed of a cotton fiber-reactive dyed velour sheet having a decorative pattern on one side; and said first and second panels are constructed from a cotton fiber-reactive dyed velour material, each having a decorative pattern on one side.

3. A beach towel and tote bag as in claim 2, wherein said first panel and said second panel decorative patterns face each other, whereby when said tote bag mode is utilized and said first and second panels are turned inside out, their decorative patterns are presented.

* * * * *